US005078118A

United States Patent [19]

Perrone

[11] Patent Number: 5,078,118

[45] Date of Patent: Jan. 7, 1992

[54] BREECH CONSTRUCTION FOR AIR GUN

[75] Inventor: Aldo Perrone, Mississauga, Canada

[73] Assignee: Brass Eagle Inc., Ontario, Canada

[21] Appl. No.: 453,858

[22] Filed: Dec. 20, 1989

[30] Foreign Application Priority Data

Aug. 13, 1989 [CA] Canada ..... 609998

[51] Int. Cl.[5] ..... F41B 11/06

[52] U.S. Cl. ..... 124/74; 124/73

[58] Field of Search ..... 124/56, 70, 71, 72, 124/73, 74

[56] References Cited

U.S. PATENT DOCUMENTS

| | | | |
|---|---|---|---|
| 749,519 | 1/1904 | Benjamin | 124/73 X |
| 1,292,665 | 1/1919 | Udesen | 124/73 |
| 1,838,999 | 12/1931 | Mihalyi | 124/73 |
| 2,293,957 | 8/1942 | Wells | 124/73 X |
| 2,526,592 | 10/1950 | Tratsch | 124/73 |
| 3,381,403 | 5/1968 | Murdoch | 124/73 X |
| 3,741,189 | 6/1973 | Kester et al. | 124/74 X |
| 4,191,158 | 3/1980 | Curran | 124/74 X |

*Primary Examiner*—Peter M. Cuomo
*Assistant Examiner*—John Ricci
*Attorney, Agent, or Firm*—Wegner, Cantor, Mueller & Player

[57] ABSTRACT

An air gun for firing pellets having a unique aluminum breech formed by extrusion. Extending through the breech is a main, large longitudinal passageway in which the hammer mechanism and gas valve system is arranged. A smaller longitudinal passageway for compressed gas is located at one side of the main passageway and is connected to the main passageway by an opening in a central part of the breech. There is a housing for attaching a gas cylinder at the rear end of the breech. In this housing is a further gas passageway for delivering compressed gas from the cylinder to the smaller passageway in the breech. A sealed passageway in the valve body leads from the opening in the center part of the breech to a gas chamber in the valve body.

15 Claims, 5 Drawing Sheets

BREECH CONSTRUCTION FOR AIR GUN

BACKGROUND OF THE INVENTION

This invention relates to air guns for firing pellets and the like.

A variety of air guns for firing pellets and BB's are known including special air guns for firing paint pellets used in playing outdoor games. Such guns commonly employ a standard gas cylinder holding compressed gas which must be attached to or housed in a secure manner in the gun. In some guns a gas cylinder is arranged in the gun handle or pistol grip while in others it is attached to the rear end of the gun. The compressed gas from the cylinder is delivered to a gas valve system in the gun and compressed gas is released from this system in order to fire the pellet by a trigger mechanism.

Recent U.S. Pat. No. 4,531,503 issued July 30, 1985 to R. C. Shepherd describes a gas powered repeating pistol wherein the gas cylinder is stored in the handle portion. On the main frame of the pistol above the handle is a pressure chamber having a valve at its forward end. The barrel in this known pistol is slidably mounted and the hammer is located at the rear end of the pistol. Mounted on top of the barrel is a tubular magazine which can carry a number of pellets such as paint pellets. The pressurized gas is delivered to the pressure chamber from the gas cylinder through a short vertical tube mounted in the bottom wall of the pressure chamber.

Early U.S. Pat. No. 2,640,476 issued June 2, 1953 to L. K. Spink describes a pneumatic gun wherein the gas cylinder is mounted to the rear of the breech of a gun. The capsule is mounted in a holder in the form of a partial sleeve and it has a neck threaded for mounting on the rear end of a valve housing. The rear portion of this housing has a pointed pin for breaking the seal of a capsule as it is being mounted. The housing contains a central passageway that delivers the compressed gas to the valve unit of the gun.

Applicant's co-pending Canadian patent application Ser. No. 578,891 filed Sept. 29, 1988 and entitled "Air Gun" describes a gun for firing paint pellets wherein a hammer mechanism is mounted in a rear end of the pellet-firing barrel. The gas cylinder for this gun is mounted in an upper barrel mounted directly above and parallel to the pellet-firing barrel. This known gun has a gas valve system arranged in the lower barrel in front of the hammer. A hole extends between the two barrels and is located along a portion of the upper barrel that holds the gas cylinder. Compressed gas passes through this hole and into the gas valve system of the gun.

It is an object of the present invention to provide an air gun for firing pellets that has a unique breech having not only a main longitudinal passageway that contains the hammer mechanism and the gas valve system, but a smaller longitudinal passageway for compressed gas located at one side of the main passageway. This smaller passageway provides a reliable conduit for delivering compressed gas from a cylinder located at the rear of the gun to the gas valve system in the main passageway.

It is a further object of the invention to provide a breech for an air gun having its own passageway for compressed gas, which breech is relatively simple and inexpensive to manufacture.

SUMMARY OF THE INVENTION

According to one aspect of the invention, there is provided an air gun for firing pellets having a gas valve system that includes a valve body and an elongate breech comprising a unitary metal member and having front and rear ends, said breach having formed therein both a main longitudinal passageway and a smaller longitudinal passageway located at one side of the main passageway. The smaller passageway is connected by an outlet opening to the main passageway and the valve system and has a closed off, sealed rear end. There is a mechanism for holding a gas cylinder containing compressed gas and a passage for delivering compressed gas from the cylinder to an inlet of the smaller longitudinal passageway. The inlet is an opening connecting the smaller and main passageways in a rear end portion of the breech.

Preferably, the breech is a unitary aluminum extrusion, the longitudinal passageways being formed during the extrusion process.

According to a further aspect of the invention, an air gun for firing pellets comprises an elongate breech having a front end, a rear end, a main longitudinal passageway with an open front end, and a smaller longitudinal passageway for compressed gas located at one side of the main passageway. This smaller passageway is connected to the main passageway by an opening in a central part of the breech. A barrel through which pellets are fired is connected to the front end of the breech. A hammer mechanism is mounted in the breech and there are means for attaching a gas cylinder to the rear end of the breech. The attaching means includes a further gas passageway for delivering compressed gas from the cylinder to the smaller passageway in the breech. The gun also includes a gun handle connected to the breech and a trigger mechanism. A gas valve system is arranged in the breech in front of the hammer mechanism and this system has a valve body having a gas chamber therein. This system includes a sealed passageway leading from the opening in the central part of the breech to the gas chamber. There are also means for operating the hammer mechanism and means for releasing compressed gas from the aforementioned chamber in order to fire a pellet when the hammer mechanism is released.

In one preferred embodiment the smaller longitudinal passageway has a closed off, sealed rear end and a further opening connects the smaller passageway to the main passageway in a rear end portion of the breech.

Further features and advantages will become apparent from the following detailed description taken in conjunction with the accompanying drawings.

DETAILED DESCRIPTION OF PREFERRED EMBODIMENT

Figure 1:
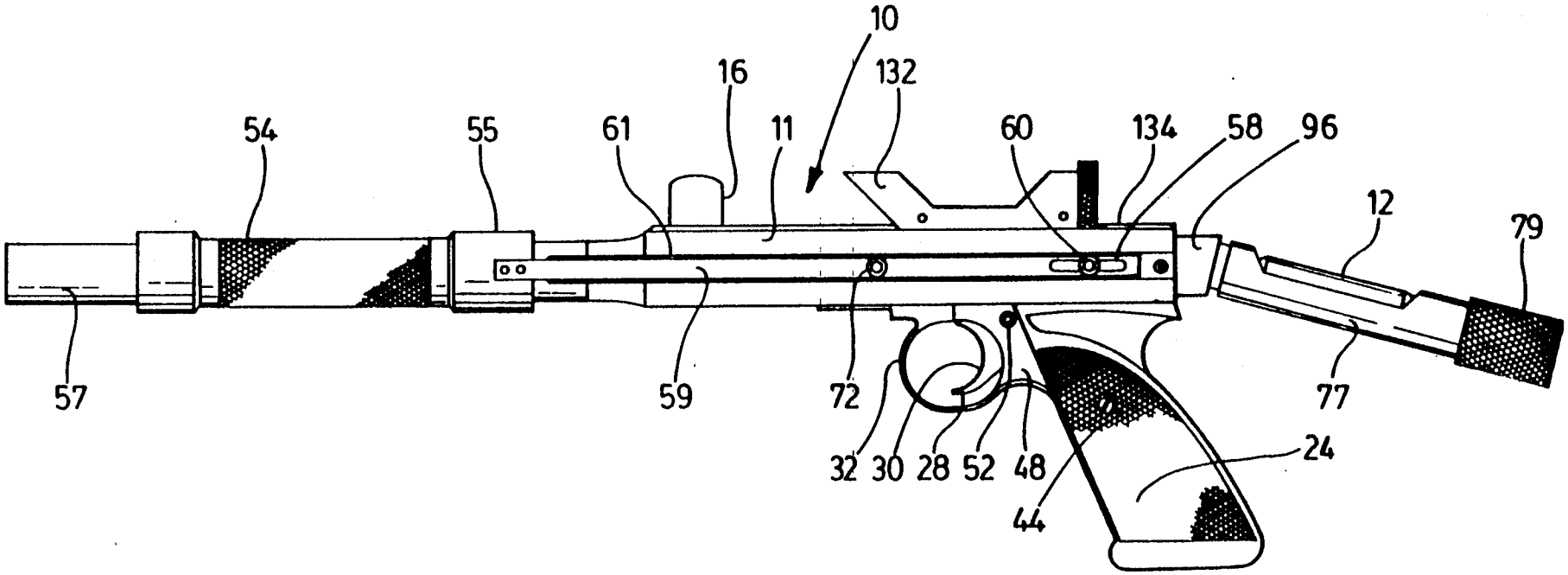
FIG. 1 is a side view of an air gun constructed in accordance with the invention.

A completely assembled air or gas gun 10 constructed in accordance with the invention is shown in FIG. 1. The illustrated gun employs a $CO_2$ cylinder 12 mounted at the rear end of the breech. The gun is adapted to fire paint pellets 14 (see FIG. 3) of known construction. The pellets can be inserted into the front end of an elongate breech 11 through a short tubular member 16. The member 16 is threaded at its bottom end and these threads connect into a threaded opening 17 formed in the breech (see FIG. 2). A magazine of known construction holding a number of paint pellets can be attached to the top end of the tubular member 16. The pellets drop individually into a main longitudinal passageway 18 that extends through the breech.

Figure 2:
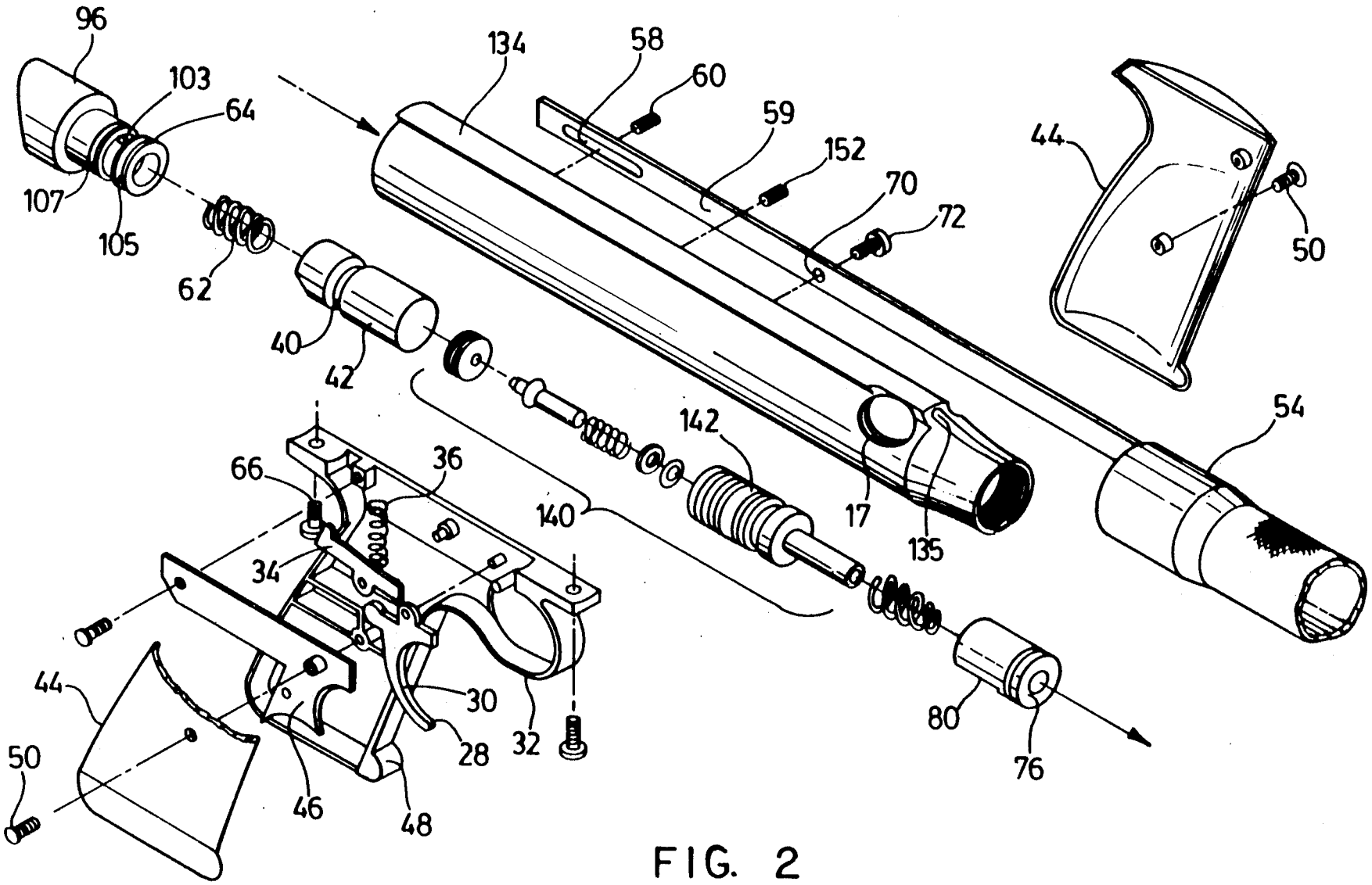
FIG. 2 is an exploded view showing various components that make up the air gun of FIG. 1 but omitting the attachable barrel.

The gun 10 is held by means of a gun handle 24, the parts of which can be seen in FIG. 2. The gun 10 is fired by means of a trigger mechanism 28 which itself is of known construction and therefore this mechanism will not be described in detail. This trigger mechanism is available from the Crossman Company located in Bloomingfield, N.Y., U.S.A. The trigger mechanism includes the trigger 30, a trigger enclosure 32 and a trigger operated lever 34. In this mechanism, the rear end of the lever 34 is lowered by pressing the trigger 30 and then the lever rear end is pushed after release of the trigger by the spring 36. The lever 34 has an upstanding projection on its rear end which engages in an annular groove 40 that extends about a hammer 42 located in the breech 11. It will thus be understood how the hammer is released and the gun is fired by pulling on the trigger 30.

The aforementioned gun handle 24 includes two hand grip components 44, a cover 46 and a grip frame 48. The hand grips are held in place by suitable screws 50. A safety pin is provided at 52 just to the rear of the trigger.

Figure 3:
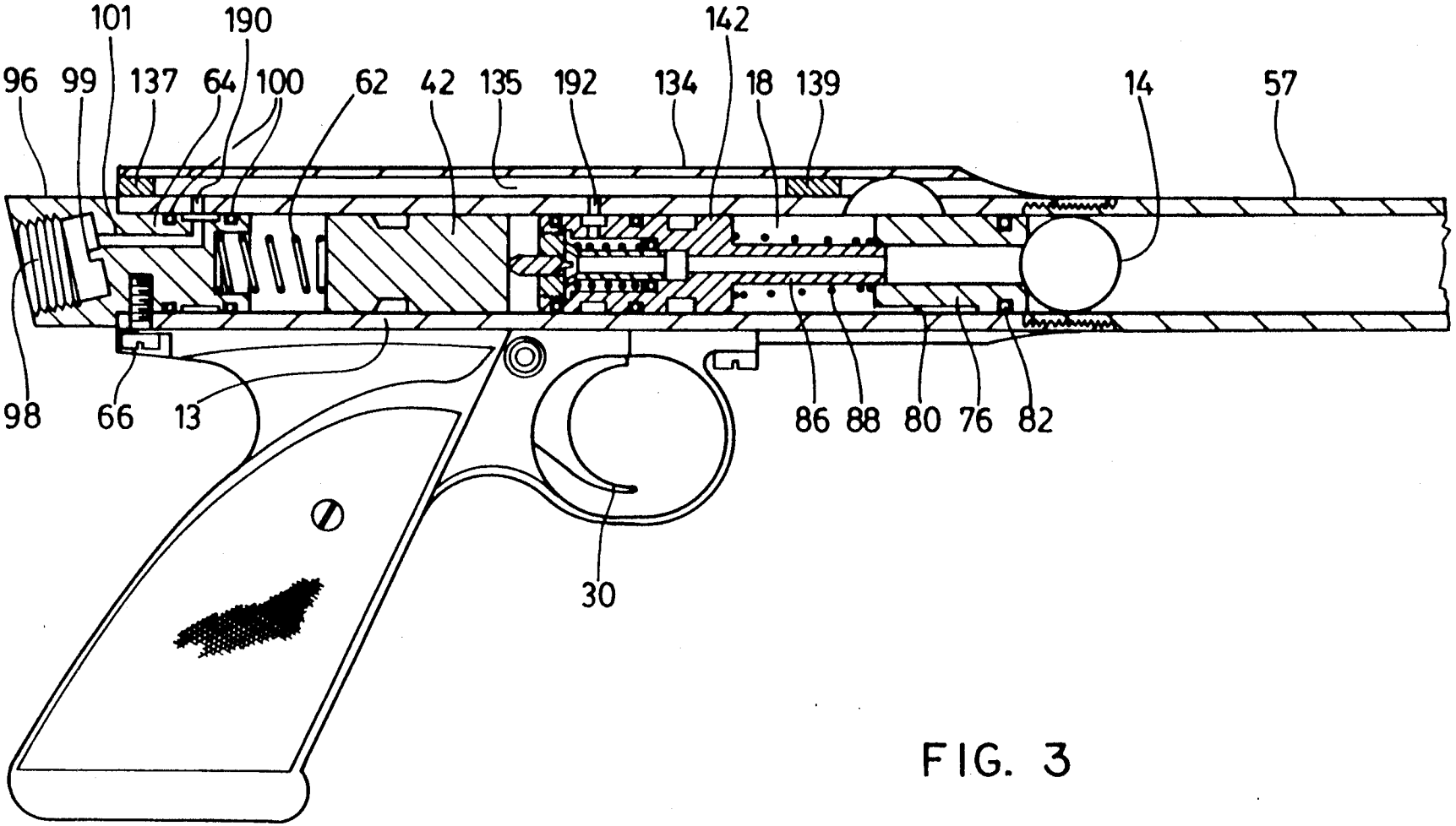
FIG. 3 is a right side view of the air gun of FIG. 1, which view shows the breech and a rear portion of the barrel in axial cross-section for purposes of illustration.

The gun 10 is loaded by pulling back on a slidable pump member 54, the construction of which can be seen from FIGS. 1 and 2. The pump member comprises a tubular portion 55 that extends around an elongate barrel 57, and a steel strip 59 that extends along a groove 61 formed on one side of the breech 11. Preferably, the central section of the tubular portion 55 has a slightly reduced diameter than the end portions and is knurled in order to provide a good grip. Near the rear end of the steel strip 59 is an elongate slot 58. A long pump screw 60 extends through the slot 58 and it is threaded into an opening in the hammer 42. The final rearward movement of the pump member 54 will pull the hammer 42 rearward against the pressure of a hammer spring 62 which is retained in the breech 11 by rear plug member 64. The rear plug member 64 is secured in the breech by means of a set screw 66. This set screw 66 also fastens the grip frame 48 to the breech as illustrated in FIG. 3.

Figure 5:
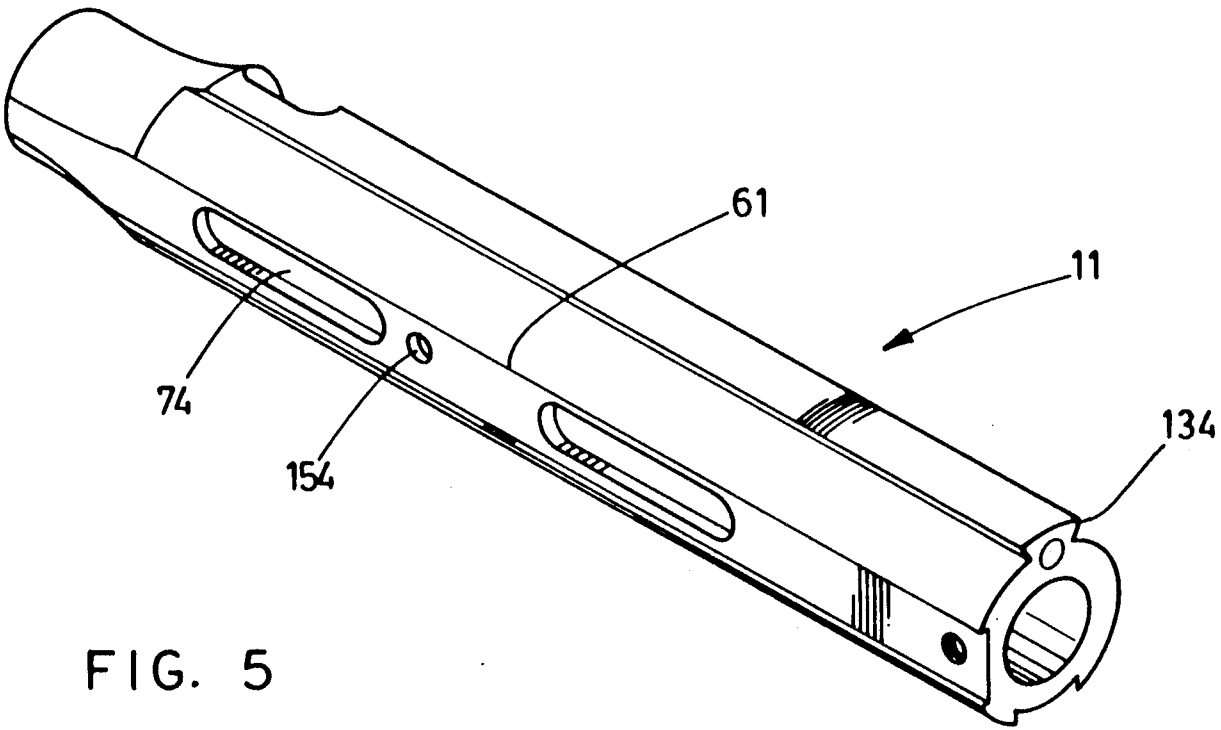
FIG. 5 is a perspective view showing the left side of the breech member only of the air gun.

The pump member 54 also has a circular hole 70 located forwardly of the slot 58. Through this hole extends a pump screw 72 which also extends through an elongate slot 74 formed in the side of the breech 11 (see FIG. 5). The end of the screw 72 is threaded into a bolt 76. In this way the rearward movement of the pump member will draw the bolt 76 rearwardly so that a paint pellet 14 can drop through the opening 17 in the breech. When the pump member moves forwardly to its forwardmost position, the paint pellet in front of the bolt is ready to be fired. The bolt 76 is generally cylindrical except for a flat side 80 positioned at the bottom. Mounted near the front end of the bolt is a suitable O-ring 82 which seals a small gap between the bolt and the inside of the breech when the bolt is in its forwardmost position as shown in FIG. 3. The bolt has a central axial hole or passageway 84 in order to receive a hollow pin 86 described in more detail hereinafter. Arranged about the pin 86 is a bolt spring 88 which acts to push the bolt and the attached pump member towards their forward position when the pump member is released. Preferably the bolt spring is conical so that it requires a minimum space when compressed and the narrow end of the spring is arranged against the rear surface of the bolt.

The preferred illustrated gun has means for attaching a gas cylinder to the rear end of the breech and also for punching a hole in the gas cylinder. In the illustrated gun, this attaching means is provided by the aforementioned rear plug member 64. The cylinder 12 is placed in a holder 77 which is open on one side as shown in FIG. 1. This holder has knurled outer end 79 in the illustrated version. The holder 77 detachably connects to a cup section 96 formed on the rear of the plug member 64. This cup section 96 has a cavity 98 into which projects the valve end of the gas cylinder. The valve of the cylinder is contacted by a centrally located projection 99 which causes the compressed gas in the cylinder to escape through a gas passageway 101. This passageway is L-shaped so that its outlet 103 is located at the top of the plug member as shown in FIG. 2. Circumferential grooves 105 and 107 are formed around the plug member to provide accomodation for O-ring seals 100 located on opposite sides of the outlet 103. Thus the compressed gas cannot escape past the ends of the plug member.

Mounted on top of the breech 11 is a detachable gun sight 132. Extending along the top of the breech in a longitudinal direction is a dovetail connector 134 which can be used to attach the gun sight. Preferably this connector 134 is continuous, terminating a short distance from the front end of the breech. Because of this dovetail connector, the breech 11 has a thicker top section and extending longitudinally through this thicker wall of the breech is a smaller passageway 135 which is used to deliver compressed gas from the gas cylinder 12 to the valve system of the gun. This smaller passageway is formed when the aluminum breech 11 is extruded. After the initial forming process, the rear end of the passageway 135 is plugged and sealed as indicated at 137 in FIG. 3. Also the forward end of the passageway 135 is also plugged and sealed as indicated at 139. Thus the escape of compressed gas through either end of the passageway is prevented.

Figure 4:
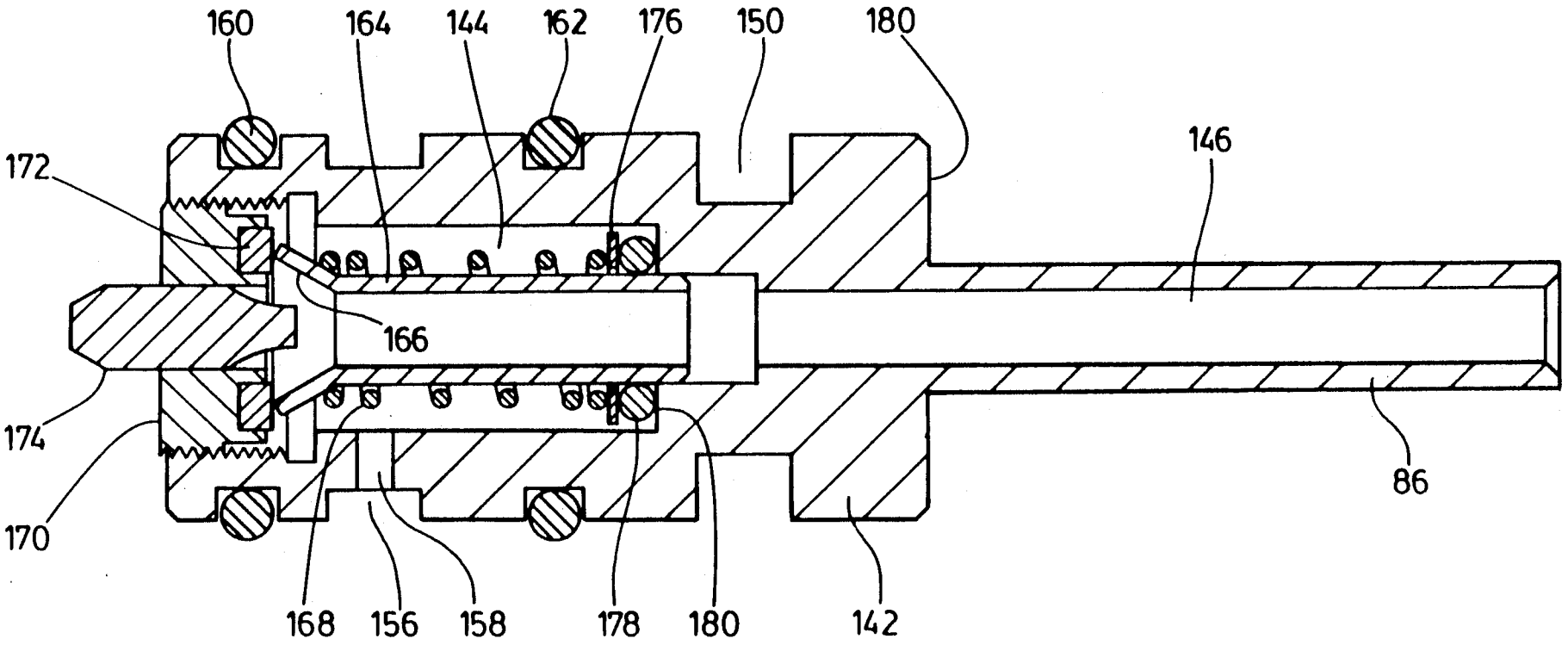
FIG. 4 is an axial cross-section of the valve body that is mounted in the breech and the components arranged therein.

The breech 11 contains a gas valve system indicated generally at 140 in FIG. 2. This system which is arranged in front of the hammer 42 includes a valve body 142 fixedly located in the barrel and illustrated in detail in FIG. 4. This valve body has a gas chamber 144 therein and a forward gas passageway 146 which is connected to the gas chamber when the gun is fired. The passageway 146 extends through the aforementioned pin 86 which is an integral extension of the valve body. Extending around the valve body is an annular groove 150. The valve body is fixed in the breech by means of one or two set screws 152 which project into the groove 150. The screw or screws 152 are threaded into one or two holes 154 located in one or both sides of the breech. There is also a second annular groove 156 that extends around the valve body and that forms part of a sealed passageway leading to the gas chamber 144. Another part of this passageway is a radially extending hole 158 that opens into the groove 156. Mounted on opposite sides of the groove are two O-ring seals 160 and 162 that seal the gap between the valve body and the interior of the breech.

Means are provided for releasing compressed gas from the chamber 144 and through the forward gas passageway 146 to fire a pellet when the hammer is released. In particular, there is a valve stem 164 with a shoulder 166 formed thereon. A first hollow portion of the valve stem extends through a valve spring 168 which spring biases the valve stem in the rearwards direction. A valve nut 170, preferably made of brass, closes the gas chamber 144. This nut has external threads which engage threads formed in the end of the valve body. The valve nut is preferably recessed on its inside surface to accommodate a nylon washer seal 172 which is engaged by the shoulder portion of the valve stem. The valve stem includes a solid second portion 174 that extends through and out of a central hole in the valve nut. This solid second portion is struck by the hammer 42 when the gun is fired.

At the front end of gas chamber 144 is a steel valve washer 176 against which one end of the spring rests. Behind this washer is an O-ring seal 178 which rests against a shoulder 180 formed in the valve body. It will be understood that O-ring seal seals the gap between the valve stem 164 and the side of the gas chamber. Accordingly, in order for compressed gas to escape, it must pass around the shoulder 166 of the valve stem and into the central passageway of the valve stem. When the valve body is installed in the breech, the aforementioned bolt spring 88 has one end resting against a front surface of the valve body. This bolt spring biases both the bolt and the pump to a forward position.

It will be clear from an examination of FIG. 3 how compressed gas passes from the passageway 101 in the rear plug member to the valve system of the gun. The gas passes into an inlet opening 190 formed in the top of the rear end portion of the breech. The compressed gas then passes through the passageway 135 and through an outlet opening 192 located in a central part of the breech. This outlet opening connects the smaller passageway to the main passageway 18 and it is aligned to open into the aforementioned peripheral groove 156 of the valve body. Thus, an inexpensive and easily formed passageway is provided for delivery of the compressed gas from the rear end of the gun to the valve system.

Various modifications and changes to the described gas fired gun will be apparent to those skilled in this art after considering the above description. Accordingly, all such modifications and changes as fall within the scope of the appended claims are intended to be part of this invention.

I therefore claim:

1. An air gun for firing pellets comprising:

an elongate breech having a front end, a rear end, a main longitudinal passageway with an open front end, and a smaller longitudinal passageway for compressed gas located at one side of said main passageway, said smaller passageway being connected to said main passageway by an opening in a central part of said breech;

a barrel through which pellets are fired connected to said front end of said breech;

a hammer mechanism mounted in said breech;

means for attaching a gas cylinder to said rear end of said breech, said attaching means including a further gas passageway for delivering compressed gas from said cylinder to said smaller passageway in the breech;

a gun handle connected to said breech;

a gas valve system arranged in said breech in front of said hammer mechanism, said system including a valve body having a gas chamber therein, said system including a sealed passageway leading from said opening in the central part of the breech to said gas chamber;

means for operating said hammer mechanism; and means for releasing compressed gas from said chamber in order to fire a pellet when said hammer mechanism is released.

2. An air gun according to claim 1 wherein said breech is a unitary aluminum member formed by extrusion.

3. An air gun according to claim 1 wherein said smaller longitudinal passageway has a closed off, sealed rear end and a further opening connects said smaller passageway to said main passageway in a rear end portion of said breech.

4. An air gun according to claim 3 wherein said breech is formed with a longitudinally extending, dovetail connector on top thereof for attachment of a gun sight.

5. An air gun according to claim 3 wherein said hammer operating means includes a pump member slidable along the exterior of said barrel and said breech is formed with a longitudinal groove extending along its length on one side, said groove accommodating a rearward extension of said pump member.

6. An air gun according to claim 1 wherein said main passageway is threaded at its open front end for detachably connecting said barrel.

7. An air gun according to claim 1 wherein said breech is formed with a longitudinally extending, continuous, dovetail connector on top thereof and said smaller passageway is located in a thicker top section of said breech provided for forming said connector.

8. An air gun for firing pellets having a gas valve system that includes a valve body, an elongate breech comprising a unitary metal member and having front and rear ends, said breech having formed therein both a main longitudinal passageway and a smaller longitudinal passageway located at one side of said main passageway, said smaller passageway being connected by an outlet opening to said main passageway and said valve system and having a closed off, sealed rear end, means for holding a gas cylinder containing compressed gas, and passage means for delivering compressed gas from said cylinder to an inlet of said small longitudinal passageway, wherein said inlet is an opening connecting said smaller and main passageways in a rear end portion of said breech.

9. An air gun according to claim 8 wherein said breech is an aluminum extrusion.

10. An air gun according to claim 9 wherein said holding means is a plug member connected to the rear end of said breech and said passage means are formed in and extend through said plug member.

11. An air gun according to claim 8 wherein said breech is formed with a longitudinally extending dovetail connector on top thereof, said smaller passageway being located in a thicker top section of said breech provided for purposes of said connector.

12. An air gun for firing pellets having a gas valve system that includes a valve body, an elongate breech comprising a unitary metal member and having front and rear ends, said breech having formed therein both a main longitudinal passageway and a smaller longitudinal passageway located at one side of said main passageway, said smaller passageway being connected by an outlet opening to said main passageway and said valve system, means for holding a gas cylinder containing compressed gas, said holding means being a plug member connected to the rear end of said breech, and passage means for delivering compressed gas from said cylinder to an inlet of said smaller longitudinal passageway, said passage means being formed in and extending through said plug member.

13. An air gun for firing pellets having a gas valve system that includes a valve body, an elongate breech comprising a unitary metal member and having front and rear ends, said breech having formed therein both a main longitudinal passageway and a smaller longitudinal passageway located on top of said main passageway, said smaller passageway being connected by an outlet opening to said main passageway and said valve system, said breech being formed with a longitudinally extending dovetail connector on top thereof, said smaller passageway being located in a thicker top section of said breech provided for purposes of said connector, means for holding a gas cylinder containing compressed gas, and passage means for delivering compressed gas from said cylinder to an inlet of said smaller longitudinal passageway.

14. An air gun according to claim 13 wherein said holding means is a plug member connected to the rear end of said breech and said passage means are formed in and extend through said plug member.

15. An air gun according to claim 13 wherein said breech is an aluminum extrusion.

* * * * *